United States Patent [19]

Leopold

[11] 4,240,553

[45] * Dec. 23, 1980

[54] FOLDING LINER FOR SHIRTS AND SIMILAR PACKAGED GARMENTS

[76] Inventor: Leo Leopold, Austrasse 65, 7140 Ludwigsburg, Fed. Rep. of Germany

[ * ] Notice: The portion of the term of this patent subsequent to Sep. 26, 1995, has been disclaimed.

[21] Appl. No.: 893,540

[22] Filed: Apr. 4, 1978

Related U.S. Application Data

[63] Continuation-in-part of Ser. No. 777,519, Mar. 14, 1977, Pat. No. 4,116,335.

[30] Foreign Application Priority Data

Apr. 4, 1977 [DE] Fed. Rep. of Germany ..... 2714977

[51] Int. Cl.[3] ..... B65D 73/00

[52] U.S. Cl. ..... 206/492; 206/297; 223/71; 229/87 S

[58] Field of Search ..... 206/292, 295, 296–299, 206/278, 492, 495; 229/75, 84, 87 A, 87 S, DIG. 3, DIG. 4; 2/117, 255; 223/66, 71, 87, 84, 83

[56] References Cited

U.S. PATENT DOCUMENTS

| | | | |
|---|---|---|---|
| 1,103,742 | 7/1914 | Damman | 229/87 S |
| 2,004,098 | 6/1935 | Andrews | 223/71 X |
| 2,068,006 | 1/1937 | De Frances | 229/87 S |
| 2,146,052 | 2/1939 | Blumenstock | 223/71 X |
| 2,353,344 | 7/1944 | Lighter | 229/87 S |
| 2,685,403 | 8/1954 | Glazer et al. | 229/87 S |
| 4,116,335 | 9/1978 | Leopold | 206/297 |

FOREIGN PATENT DOCUMENTS

| | | |
|---|---|---|
| 315731 | 6/1974 | Austria . |
| 1925115 | 11/1970 | Fed. Rep. of Germany . |

*Primary Examiner*—Joseph Man-Fu Moy
*Attorney, Agent, or Firm*—Joseph A. Geiger

[57] ABSTRACT

A cardboard folding liner for shirts, blouses, pajamas, and similar garments which are foldable into a flat compact package for shipment and display, the liner having a pair of inwardly foldable wing panels adjoining each longitudinal side of a rectangular center panel and delineated by two pairs of weakened fold lines. In the folded state, the wing panels clamp portions of the garment between them and the center panel, the folded state being maintained by a closure which consists of a closure flap in the form of an integral laterally protruding extension of one of the two inner wing panels which cooperates with a closure notch in the top edge of the other inner wing panel.

9 Claims, 10 Drawing Figures

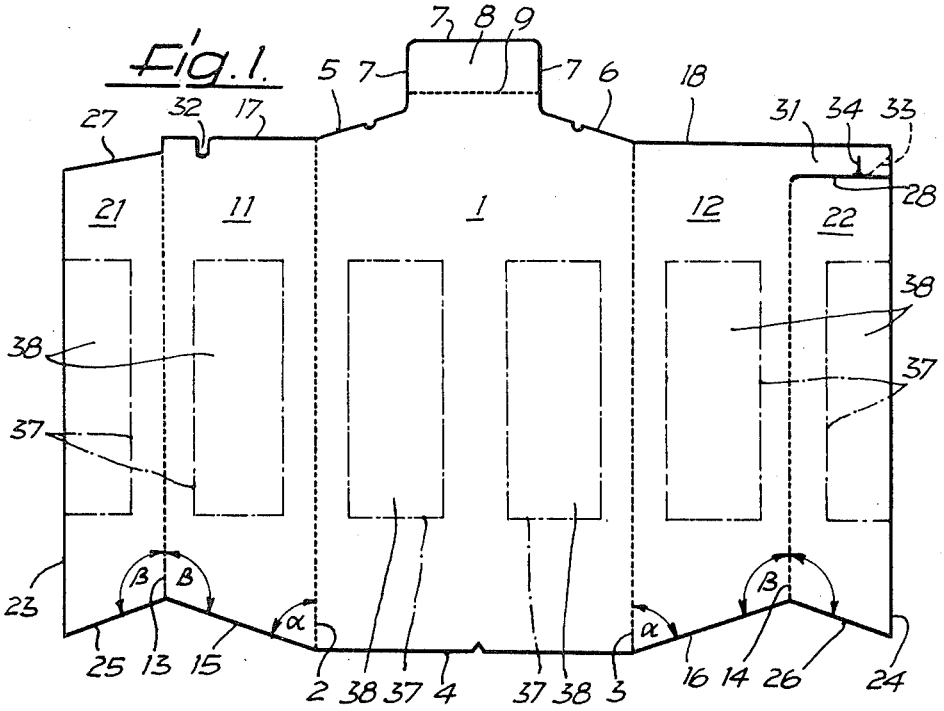
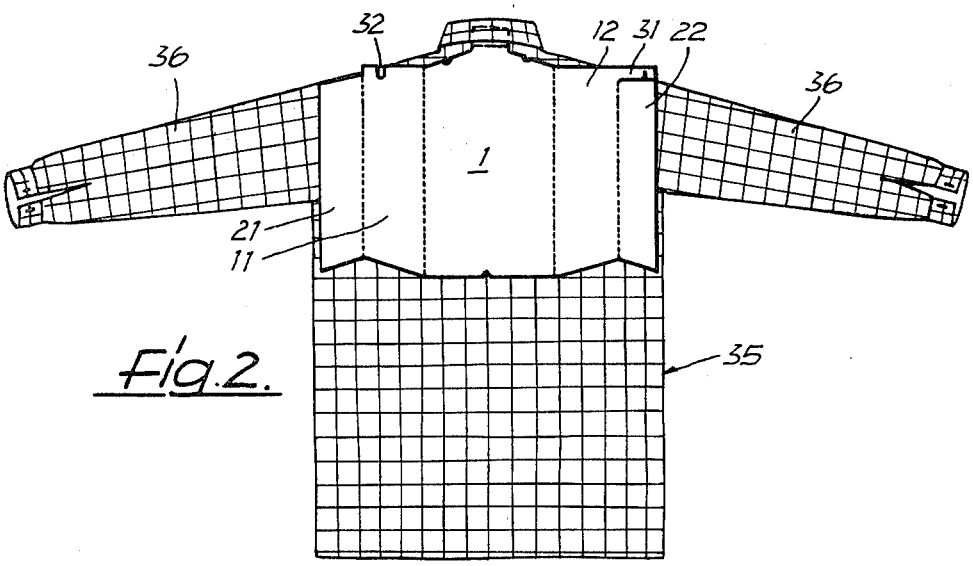
Fig. 2.

FOLDING LINER FOR SHIRTS AND SIMILAR PACKAGED GARMENTS

CROSS REFERENCE TO RELATED APPLICATION

This application is a continuation-in-part of my copending application Ser. No. 777,519, filed Mar. 14, 1977, now U.S. Pat. No. 4,116,335.

BACKGROUND OF THE INVENTION

1. Field of the Invention

The present invention relates to garment packaging and display accessories, and, more particularly, to disposable liner panels for outer garments such as men's shirts, women's blouses, pajamas, and the like, which are folded into flat packages for transportation, storage, and sales display.

2. Description of the Prior Art

It has become a common practice to package men's shirts, women's blouses, pajamas, and similar outer garments for transportation, storage, and retail sales display in such a way that the particular garment is folded over and attached to a supporting panel or liner of cardboard. The folded garment may then be inserted into a bag or flat carton of which at least the upper side is transparent, in order to permit visual inspection of the front side of the packaged garment.

Such a folding liner is disclosed in my earlier copending application Ser. No. 777,519, filed Mar. 14, 1977, the folding liner consisting of a rectangular center panel and a pair of inner and outer wing panels attached to each longitudinal side of the center panel, the lines of attachment between the center panel and inner wing panels, and between the inner and outer wing panels, respectively, serving as fold lines, being suitably weakened by fold line perforations. In the folded position, the wing panels of the initially flat folding liner are superposed over their respective lateral halves of the center panel, the outer wing panels thereby coming to lie between the inner wing panels and the center panel. In this position, the folded wing panels exert a clamping action on the garment between the inner and outer wing panels on the one hand, and between the outer wing panels and center panel on the other hand.

The assembly is maintained in its folded state by a flap-type closure which consists of a hinged flap formed from an integral partial cutout of one of the two inner wing panels and a cooperating closure notch in the other inner wing panel which is engageable by an incision of the hinged closure flap. The latter is preferably of elongated rectangular shape and located a short distance below the upper edge of the inner wing panel, extending transversely to the fold lines of the liner. The two longitudinal sides and the near transverse side of the rectangular closure flap are formed by a C-shaped cut through the liner material, while the distal transverse side of the flap remains attached to the inner wing panel of the folding liner, thereby forming a bending hinge.

At the beginning of the folding operation, before the flat folding liner is placed against the backside of the garment, the closure flap must be folded out of its cutout, towards that face of the liner which contacts the garment, so that the closure flap extends outwardly from the inner wing panel and partially overlaps the outer wing panel. The subsequent inward folding of the outer wing panels and underlying garment portions then exposes a length portion of the closure flap which, after the wing panels are completely folded onto the center panel, becomes fully exposed, reaching over the center line of the folded assembly, so that the closure flap can be hooked into the closure notch of the opposite inner wing panel.

This folding liner requires no accessory fasteners, like pins or clamps, the garment being clamped in superposed folded layers by the wing panels of the folding liner, and the folded wing panels, in turn, being safely maintained in their folded position by the flap-type closure. This closure, being an integral cutout of the folding liner, without increasing its overall size and material requirements, thus minimizes the material cost of the folding liner. However, it has been found to be a disadvantage that this closure requires specific manipulative steps at the beginning of the folding operation, thereby increasing the manual labor requirements in the folding operation.

SUMMARY OF THE INVENTION

Underlying the present invention is the objective of providing an improved folding liner of the type which is described above, the improvement being aimed at eliminating the earlier-mentioned operative steps on the closure mechanism of the folding liner, at the beginning of the folding operation.

The present invention, in order to achieve this objective, suggests an improvement in a folding liner of the type which is disclosed in my copending earlier application Ser. No. 777,519 of Mar. 14, 1977, the improvement comprising a flap-type closure with an integral flap which, rather than being cut and folded out of the surface area of the inner wing panel, forms a laterally outwardly oriented extension of the inner wing panel, at the upper edge of the latter, so as not to require any preparatory bending of the closure flap, when the folding liner is placed over the garment, at the beginning of the assembly operation. This integral extension of the inner wing panel is so arranged that it will not be covered by the sleeve of the garment, so that, at the end of the folding operation, it remains exposed and is conveniently aligned with the closure notch in the other inner wing panel, for engagement therewith.

The proposed novel closure flap is preferably so arranged that it is coextensive with the outer wing panel, having a length which is equal to the width of said panel, so that a simple transverse cut across the width of the outer wing panel produces the lower longitudinal edge of the closure flap and the top edge of the outer wing panel. While this novel arrangement requires a small increase in the overall material requirements of the folding liner, this increase is negligible, in comparison to the resulting simplification of the assembly operation and the structural strengthening of the flap-type closure mechanism.

In a preferred embodiment of the invention, the upper longitudinal side of the closure flap forms a straight continuation of the top edge of the inner wing panel which, itself, is aligned with the top edge of the opposite inner wing panel. The result of this particular liner shape is that, in the folded condition, the upper side of the closure flap is aligned with the top edge of the opposite inner wing panel, thereby not only giving a pleasing appearance, but also strengthening the folded liner structure in the area of the closure, a feature which is important in connection with the subsequent and final folding step, when the lower portion of the garment is refolded over the back of the closed folding liner and an end portion thereof is inserted between the center panel and the closed wing panels.

BRIEF DESCRIPTION OF THE DRAWINGS

Further special features and advantages of the invention will become apparent from the description following below, when taken together with the accompanying drawings which illustrate, by way of example, an embodiment of the invention, represented in the various figures as follows:

FIG. 1 shows an embodiment of the invention in the form of a flat developed folding liner for foldable garments, particularly men's dress shirts;

FIG. 2 shows the folding liner of FIG. 1, at a smaller scale, placed onto the back of a dress shirt and ready for the folding operation;

DESCRIPTION OF THE PREFERRED EMBODIMENT

Figure 3:
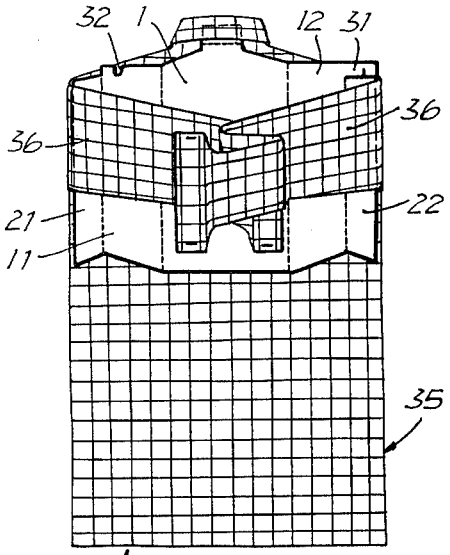
FIGS. 3 through 6 illustrate consecutive steps in the folding operation, as a result of which the shirt and the folding liner become a compact, self-contained assembly.

A preferred embodiment of the invention is illustrated in FIG. 1 which shows a folding liner for shirts in a flat, developed configuration, as stamped out of cardboard stock. This folding liner consists of an elongated center panel 1 which is delineated by two parallel lateral fold lines 2 and 3 and by a straight bottom edge 4, the latter forming right angles with the center panel fold lines 2 and 3.

The upper contour of the center panel 1 consists of two oppositely inclined straight edge portions 5 and 6 which form an obtuse angle with their associated lateral center panel fold lines 2 and 3, respectively, and which flank a central generally rectangular collar insert 8 which is the result of a C-shaped top edge cut 7. The lateral width of the collar insert 8 is approximately one-third of the width of the center panel 1. A transversely extending perforation line 9, located near the base of the collar insert 8 gives the latter a predetermined weakened bending line about which it can be bent back to conform with the angle of the shirt collar.

To the longitudinal sides of the center panel 1 are joined two elongated inner wing panels 17 and 18 whose longitudinal sides are formed by the center panel fold lines 2 and 3 and by parallel intermediate fold lines 13 and 14, respectively, constituting the outer longitudinal sides of the inner wing panels 11 and 12. The width of these two panels is just slightly less than one-half of the width of the center panel 1 so that, when they are folded inwardly over the center panel, their intermediate fold lines 13 and 14 come to almost coincide with each other, leaving a gap of approximately one millimeter width between them. The length of the inner wing panels 11 and 12 at the center panel fold lines 2 and 3 is identical to the length of the center panel 1 at those same lines, the length at their intermediate fold lines 13 and 14 being shorter, due to an upward inclination of the inner wing bottom edges 15 and 16.

The inclination of the inner wing bottom edges 15 and 16 is preferably such that an acute angle $\alpha$ of between 70° and 74° is formed between each wing panel bottom edge and its associated center panel fold line. For folding liners of conventional size, this inclination of the inner wing bottom edges 15 and 16 amounts to a recess of the intermediate fold lines 13 and 14 from the extended center panel bottom edge 4 of approximately 30 millimeters. The top edges 17 and 18 of the inner wing panels 11 and 12 are preferably straight and in line with each other, forming right angles with the fold lines on both longitudinal sides of the inner wing panels 11 and 12. The inclined edge portions 5 and 6 of the center panel 1 meet the inner wing top edges 17 and 18 at the lateral fold lines 2 and 3 of the center panel 1.

The four parallel fold lines which delineate the center panel 1 and the adjoining inner wing panels 11 and 12 are preferably arranged in the form of pre-weakened fold lines, each line containing a series of perforations or intermittant incisions for this purpose.

To the outer longitudinal sides of the inner wing panels 11 and 12 are joined two elongated outer wing panels 21 and 22 whose inner longitudinal sides are formed by the intermediate fold lines 13 and 14 and whose outer longitudinal sides are formed by the parallel outer longitudinal edges 23 and 24 of the folding liner. The outer wing panels 21 and 22 are narrower than the inner wing panels 11 and 12, their width being equal to approximately two-thirds of the width of the inner wing panels 11 and 12.

FIG. 1 shows that the length of the outer wing panels 21 and 22 is somewhat shorter than that of the inner wing panels 11 and 12, the bottom edge 25 of the left-hand outer wing panel 21 being oppositely inclined from the adjoining bottom edge 15 of the left-hand inner wing panel 11, so that identical obtuse angles $\beta$ are formed with the intermediate wing fold line 13. But, because the width of the outer wing panel 21 is less than that of the inner wing panel 21, its outer longitudinal edge 23 will not reach all the way down to the extension of the center panel bottom edge 4.

The top edge 27 of the left-hand outer wing panel 21 is inclined in the same sense, but at a smaller angle than its bottom edge 25. The enclosed angle between the outer wing top edge 27 and the intermediate fold line 13 is preferably 80°. At its inner extremity, where the outer wing top edge 27 intersects the intermediate fold line 13, it is recessed downwardly from the inner wing top edge 17 by a distance of approximately 5 millimeters.

While the bottom contours of both sets of inner and outer wing panels of the folding liner of FIG. 1 are symmetrical, in the sense of a mirror image with respect to the center panel 1, the top contours of the right-hand inner and outer wing panels 12 and 22, respectively, are different from those on the left-hand wing panels 11 and 21 of the folding liner. The top edge 28 of the right-hand outer wing panel 22 is not an exterior edge of the folding liner 1, but is oriented parallel to the extended top edge 18 of the inner wing panel 12, at a distance of approximately 15 millimeters below the latter. Also, the intermediate fold line 14 stops at the intersection with the outer wing top edge 28, thereby leaving an integral laterally outwardly extending tongue-shaped flap 31 on the upper extremity of the inner wing panel 12 which, as will be described further below, serves as part of a flap-type closure for the folding liner.

Figure 5:
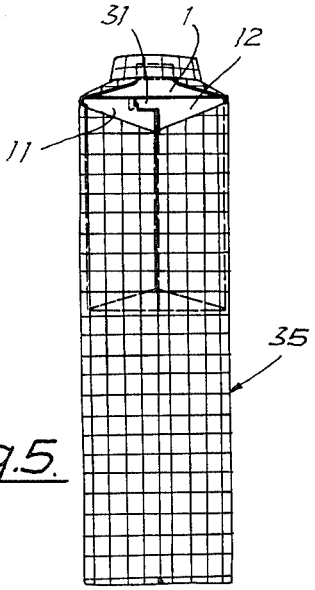
Figure 9:
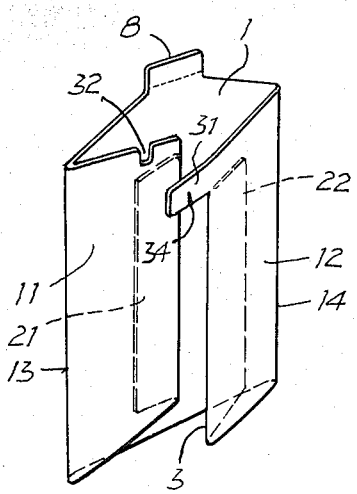
Figure 10:
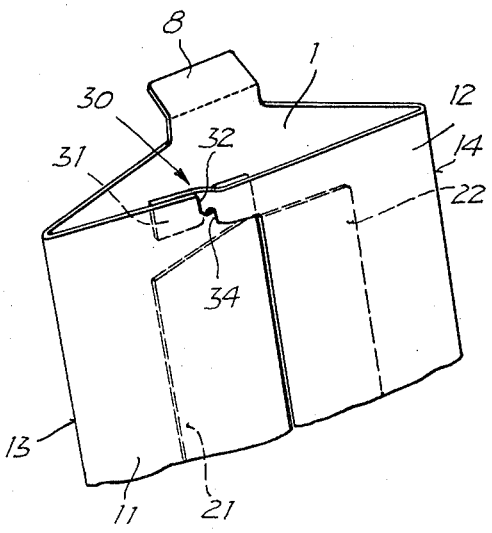

In order to retain its folded state in which it forms an assembly with a shirt, the folding liner of the invention includes a flap-type closure 30, the operation of which can best be seen in FIG. 5 and in FIGS. 9 and 10. This closure consists of a closure flap 31 formed by the earlier-described integral extension on the upper extremity of the right-hand inner wing panel 12 which, in the folded condition of the folding liner, can be engaged into a cooperating closure notch 32 of the left-hand inner wing panel 11. As can be seen in FIG. 1, the closure flap 31 is generally rectangular in outline, having parallel upper and lower sides of which the lower one if formed by the same cut which forms the top edge 28 of the outer wing panel 22. The lateral extremity of the closure flap 31 is preferably aligned with the outer longitudinal edge 24 of the outer wing panel 22, thereby giving the folding liner a rectangular overall outline in this area.

As mentioned earlier, the upper side of the closure flap 31 is a straight extension of the top edge 18 of the inner wing panel 12. The vertical width of the closure flap 31 is preferably such that the point at which its lower side—i.e. the top edge 28 of the outer wing panel 22—intersects the intermediate fold line 14, coincides approximately with the point where the extended inclined edge portion 6 of the center panel 1 would intersect the intermediate fold line 14. The result of this configuration is that the closure flap 31 lies outside that portion of the folding liner which is in contact with the shirt, when they are folded together, as shown in FIGS. 2 through 5. It should be noted that, in these figures, the position of the folding liner with respect to the shirt 35 is shown to be offset downwardly by a distance which is considerably greater than is normally preferable, in order to more clearly distinguish between the contour lines of the folding liner and of the shirt.

In the closed position, the closure flap 31 engages a closure notch 32 of the left-hand inner wing panel 11 (FIG. 10). For this purpose, the closure flap 31 has an incision 34 which extends vertically from its lower longitudinal edge to about the center of the flap 31. The closure notch 32 in the inner wing panel 11 and the incision 34 of the closure flap 31 are preferably so arranged in the lateral sense that the distance between the outer extremity of the closure flap 31 and its incision 34 is approximately equal to the vertical width of the closure flap 31. The closure notch 32 is preferably a V-shaped or U-shaped cutout of a vertical depth which corresponds to the residual width of the closure flap 31 between its incision 34 and its top longitudinal edge 18.

For greater ease of insertion of the closure flap 31 into the closure notch 32, the flap 31 may be modified by means of an oblique chamfer cut 33 which is shown in FIG. 1 with a dotted line. This chamfer cut 33 extends from the lower longitudinal side of the closure flap 31 to its outer vertical edge, leaving short original edge portions outside the incision 34 and adjacent to the upper longitudinal side of the rectangular flap contour. The residual vertical edge portion on the outer extremity of the closure flap 31 should preferably be less than the depth of the closure notch 32 so that this leading edge of the closure flap can be inserted into the closure notch 32 without necessitating an upward deflection of the closure flap 31. The chamfer cut 33 then acts as a cam surface, riding against the bottom of the notch 32, thereby automatically shifting the closure flap 31 upwardly during the insertion step, until its vertical incision 34 snaps into the closure notch 32. This modification represents a further simplification of the assembly procedure.

Referring to FIGS. 2 through 6, there will now be described the folding operation and assembly of the folding liner of the invention with a shirt which involves the following sequence of steps:

The shirt 35 is initially placed on a suitable folding table, its front side being buttoned up and facing downwardly against the table surface. This folding table (not shown) is preferably provided with a suitable depression accommodating the collar of the shirt 35. The developed folding liner is then placed onto the back side of the flat shirt, and its collar insert 8 is engaged under the shirt collar while being slightly bent downwardly about its perforation line 9. This position of the folding liner is shown in FIG. 2, the front side of the liner facing the back of the shirt 35. As mentioned earlier, the preferred position of the folding liner with respect to the shirt 35 is normally somewhat higher than that which is shown in FIG. 2.

In a first folding step, the sleeves 36 of the shirt and whatever lateral portions of the shirt itself may overlap the outer longitudinal edges 23 and 24 of the folding liner are folded inwardly over the edges 23 and 24. The sleeves are then refolded, as shown in FIG. 3, in order to place their cuffs within the surface area of the center panel 1. Alternatively, the shirt sleeves may be folded in such a way that, at the end of the folding operation, their cuffs come to lie on the front side of the shirt, within the area of the center panel 1 of the liner. In all cases, however, it is essential that a portion of the sleeves 36 and/or of the shirt 35 itself is folded inwardly into contact with the inner wing panels 11 and 12.

Figure 4:
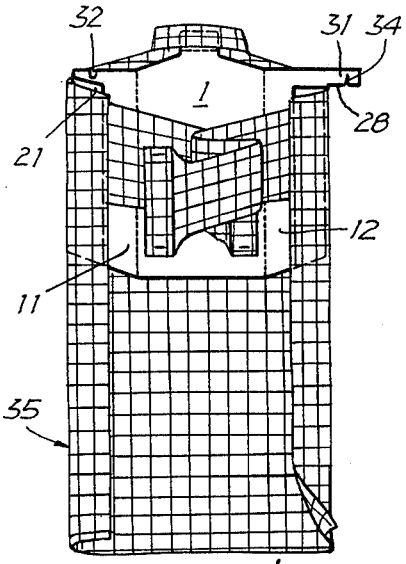

In the next folding step, the outer wing panels 21 and 22 of the folding liner are folded inwardly onto the adjacent inner wing panels 11 and 12, the same folding operation being simultaneously also performed on the sleeves 36 and on those lateral portions of the shirt 35 which lie within the longitudinally extended width of the outer wing panels 21 and 22. As can be seen in FIG. 4, this folding operation produces a clamping action on the sleeves 36 and on that marginal shirt portion which may previously have been folded over the outer wing panels 21 and 22. The closure flap 31 is not affected by this folding operation, remaining in a laterally extended, now protruding position.

In a further folding step, which is shown in FIG. 5, the inner wing panels 11 and 12 are folded onto the center panel 1, folding with them corresponding longitudinal shirt portions which lie within the extended widths of the inner wing panels 11 and 12. This second folding step means that the previously folded outer wing panels 21 and 22 and the associated shirt portions become sandwiched between the inner wing panels 11 and 12 and the center panel 1. In this twice-folded position, the inner wing panels 11 and 12 are in slight or near contact with each other along the longitudinal center line of the assembly, while the closure flap 31 which is attached to the right-hand inner wing panel 12 extends over the left-hand inner wing panel 11 towards its closure notch 32. It should be understood that, in order to obtain this configuration, the left-hand wing panel must be folded inwardly ahead of the right-hand wing panel. With a very simple movement, the closure flap 31 can then be hooked into the closure notch 32, thereby providing a locking engagement between the folded wing panels and the shirt 35 which reliably maintains the assembly in the configuration which is shown in FIG. 5.

Figure 6:
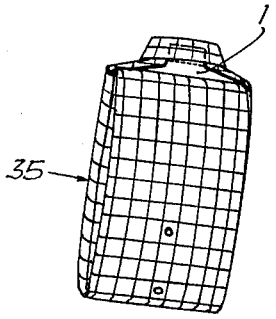
Figure 7:
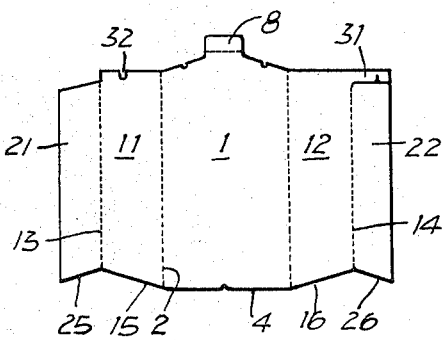
FIGS. 7 through 10 show the folding liner alone, in variously folded positions, some of them illustrated in a perspective view and at a larger scale, thereby illustrating the folding operation, as it affects the panels of the folding liner.

In a subsequent folding operation, that length portion of the shirt 35 which extends below the bottom edge 4 of the folding liner is folded upwardly about that edge, and a short end portion of the refolded shirt is finally folded over the aligned upper edges 17 and 18 of the folded inner wing panels 11 and 12 and inserted between these wing panels and the center panel 1, as is shown in FIG. 6. The result is a compact, self-contained assembly which is pleasing in appearance and which is capable of withstanding considerable handling stress without unfolding in the process.

FIG. 5 also shows that, in the folded state, the inclined overlying bottom edges 15 and 25 of one pair of wing panels and the corresponding edges 16 and 26 of the opposite pair of wing panels leave only the bottom edge 4 of the center panel 1 as a fold-supporting edge for the lower portion of the shirt 35, thereby providing additional space for the multiple layers of the shirt, in order to reduce an otherwise existing problem, as the multiple layers tend to produce a puffy appearance of the shirt at this fold.

Figure 8:
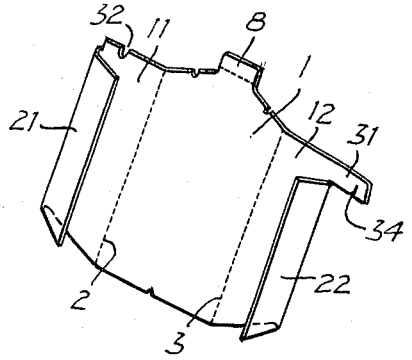

For a better understanding of the folding operation, as it affects the folding liner alone, the various successive folding stages of the liner are shown separately in FIGS. 7 through 10, as seen without the underlying shirt. The fully developed flat configuration of the folding liner of the invention is again shown in FIG. 7. FIG. 8 shows the outer wing panels 21 and 22 folded inwardly onto the inner wing panels 11 and 12, leaving the closure flap 31 extending outwardly from the right-hand inner wing panel 12. In the subsequent folding step, the left-hand inner wing panel 11 is folded onto the center panel 1, whereupon the right-hand inner wing panel 12 is similarly folded onto the right-hand side of the center panel 1.

The closure flap 31 now lies on top of the upper end portion of the left-hand inner wing panel 32, and the vertical incision 34 of the flap 31 is laterally aligned with the closure notch 32 of the inner wing panel 11. At this point, the closure members can be engaged by a slight distortion of the two wing panels 11 and 12 in the vertical sense and by bending the closure flap 31 upwardly until the bottom edge of the latter can be moved behind the top edge 17 of the left-hand inner wing panel 11, thereby permitting engagement of the incision 34 of the closure flap 31 into the closure notch 32. In the engaged position, the top edges 17 and 18—the latter forming the upper longitudinal side of the closure flap 31—form a continuous straight line.

The illustration of the folding liner which is given in FIG. 1 includes, in the center portion of its constituent panels, several rectangles which are indicated by stippled lines 37. These rectangles represent a possible modification of the folding liner, the areas within the rectangles 38 being cut away, so that, in the folded condition of the liner, the various cutouts come to overlie each other, thereby producing two liner-free rectangular areas in the made-up shirt, where the "feel" and density of the fabric can be examined by finger touch. These "soft" areas of the made-up garment are so arranged that they will not affect the taut flat outer appearance of the garment.

It should be understood, of course, that the foregoing disclosure describes only a preferred embodiment of the invention and that it is intended to cover all changes and modifications of this example of the invention which fall within the scope of the appended claims.

I claim the following:

1. A folding liner designed for assembly with a man's shirt, woman's blouse, pajamas, or a similar foldable garment in a folding operation which produces a self-contained compact package for storage, shipment and retail sales display, the folding liner comprising in combination:

an elongated, approximately rectangular center panel of a width and length which correspond substantially to the width and length of the intended package, the center panel having a top side intended to engage the shoulder portion of the garment, an oppositely located bottom side, and two substantially parallel straight longitudinal sides;

two elongated, likewise approximately rectangular inner wing panels with top and bottom sides and substantially parallel inner and outer longitudinal sides, their inner longitudinal sides forming integral junctions and lateral fold lines with the longitudinal sides of the center panel, the width of the inner wing panels being slightly less than one-half the width of the center panel; and two elongated, likewise approximately rectangular outer wing panels with top and bottom sides and substantially parallel inner and outer longitudinal sides, their inner longitudinal sides forming integral junctions and intermediate fold lines with the outer longitudinal sides of the inner wing panels, the outer wing panels being narrower than the inner wing panels;

the folding lines thus comprising a succession of five panels which are joined at four straight fold lines along which the liner material is weakened by perforations, for the wing panels to be foldable over the center panel, so that the outer wing panels come to lie inbetween the inner wing panels and the center panel and coextensive layers of said garment are clampingly held in place between said wing panels and the center panel, respectively; and closure means comprising a closure flap in the form of an integral lateral extension on the top side of one of the two inner wing panels and a closure notch on the top side of the other inner wing panel, so arranged that it is engageable by the closure flap, after the wing panels have been folded over the center panel, thereby creating a locking action which secures the folding liner in the folded state, thus maintaining said clamping action.

2. A folding liner as defined in claim 1, wherein the closure flap has upper and lower longitudinal sides, an outer side at its distal extremity, and an inner side on which it is integrally attached to the inner wing panel; and the closure flap includes, on its lower longitudinal side, a substantially vertically extending locking flank which faces laterally inwardly and is so located in the lateral and vertical sense that, in the folded state of the liner, it is in lateral alignment with, and extends at least partially below, the bottom of said closure notch of the other inner wing panel, so that the closure flap end portion which is located laterally outside said locking flank, when engaged behind said other inner wing panel, acts as a locking hook in cooperation with the closure notch.

3. A folding liner as defined in claim 2, wherein the closure flap includes an incision extending in a substantially vertical direction from its lower longitudinal side a distance into the flap, the outer flank of said incision being said locking flank.

4. A folding liner as defined in claim 2, wherein the closure flap further includes, on said flap end portion, a chamfer cut which extends outwardly and upwardly from the lower longitudinal side of the closure flap, so as to define an inclined cam surface which, in cooperation with the bottom portion of the closure notch, causes the closure flap to be deflected upwardly, when the closure flap is inserted into the closure notch in a lateral direction.

5. A folding liner as defined in claim 1, wherein said closure notch on the top side of one of the inner wing panels is a generally U-shaped slot in said panel which extends from the top edge downwardly; and the outer wing panel which adjoins this inner wing panel has a straight top edge on its upper side which is inclined outwardly and downwardly and also recessed downwardly from the top edge of the adjoining inner wing panel so that, in the folded state of the liner, said outer wing top edge is located below that portion of the closure flap which reaches laterally beyond the closure notch.

6. A folding liner as defined in claim 1, wherein the lateral extension of the inner wing panel which forms said closure flap is arranged above the top side of the associated outer wing panel; and the lower longitudinal side of the closure flap is coextensive with the top side of said outer wing panel.

7. A folding liner as defined in claim 6, wherein the two inner wing panels have on their top sides straight edges which are in substantial alignment with each other; and the upper longidutinal side of the closure flap is formed by an extension of the top edge of the inner wing panel of which the closure flap is an integral extension.

8. A folding liner as defined in claim 6, wherein the outer longitudinal sides of the outer wing panels constitute the outer lateral edges of the folding liner; and the outer side of the closure flap is formed by an edge which is in lateral alignment with an outer lateral edge of the folding liner.

9. A folding liner as defined in claim 6, 7, or 8, wherein the closure flap is generally rectangular in outline, having substantially parallel upper and lower edges which extend perpendicularly to the intermediate fold line of the outer wing panel below it;

the lower edge of the closure flap is so located in the vertical sense that, in the folded state of the liner, it is spaced a distance below the bottom of said closure notch; and the closure flap includes an incision which extends upwardly from its lower edge to a point which, in the folded state of the liner, coincides approximately with the bottom of said closure notch.

* * * * *